US008969802B1

(12) United States Patent
Blazevic

(10) Patent No.: US 8,969,802 B1
(45) Date of Patent: Mar. 3, 2015

(54) PLAYING CARD IMAGING TECHNOLOGY WITH THROUGH-THE-CARD VIEWING TECHNOLOGY

(71) Applicant: Mladen Blazevic, New York, NY (US)

(72) Inventor: Mladen Blazevic, New York, NY (US)

( * ) Notice: Subject to any disclaimer, the term of this patent is extended or adjusted under 35 U.S.C. 154(b) by 15 days.

(21) Appl. No.: 14/019,620

(22) Filed: Sep. 6, 2013

(51) Int. Cl.

| | |
|---|---|
| ***G02F 1/01*** | (2006.01) |
| ***H04N 5/33*** | (2006.01) |
| ***A63F 1/12*** | (2006.01) |
| ***A63F 1/14*** | (2006.01) |

(52) U.S. Cl.
CPC .. *H04N 5/33* (2013.01); *A63F 1/12* (2013.01); *A63F 1/14* (2013.01)
USPC ..... 250/330

(58) Field of Classification Search
CPC ..... H04N 5/33
USPC ..... 250/330
See application file for complete search history.

(56) References Cited

U.S. PATENT DOCUMENTS

| | | | |
|---|---|---|---|
| 4,531,187 | A | 7/1985 | Uhland |
| 5,605,334 | A | 2/1997 | McCrea, Jr. |
| 5,722,893 | A | 3/1998 | Hill |
| 5,770,533 | A | 6/1998 | Franchi |
| 5,941,769 | A | 8/1999 | Order |
| 6,039,650 | A | 3/2000 | Hill |
| 6,093,103 | A | 7/2000 | McCrea, Jr. |
| 6,117,012 | A | 9/2000 | McCrea, Jr. |
| 6,403,908 | B2 | 6/2002 | Stardust |
| 6,460,848 | B1 | 10/2002 | Soltys et al. |
| 6,517,435 | B2 | 2/2003 | Soltys et al. |
| 6,517,436 | B2 | 2/2003 | Soltys et al. |
| 6,520,857 | B2 | 2/2003 | Soltys et al. |
| 6,527,191 | B1 | 3/2003 | Jannersten |
| 6,527,271 | B2 | 3/2003 | Soltys et al. |
| 6,530,836 | B2 | 3/2003 | Soltys et al. |
| 6,530,837 | B2 | 3/2003 | Soltys et al. |
| 6,533,276 | B2 | 3/2003 | Soltys et al. |
| 6,533,662 | B2 | 3/2003 | Soltys et al. |
| 6,579,180 | B2 | 6/2003 | Soltys et al. |
| 6,579,181 | B2 | 6/2003 | Soltys et al. |
| 6,582,301 | B2 | 6/2003 | Hill |
| 6,595,857 | B2 | 7/2003 | Soltys et al. |
| 6,629,894 | B1 | 10/2003 | Purton |
| 6,638,161 | B2 | 10/2003 | Soltys et al. |
| 6,652,379 | B2 | 11/2003 | Soltys et al. |
| 6,663,490 | B2 | 12/2003 | Soltys et al. |
| 6,685,568 | B2 | 2/2004 | Soltys et al. |
| 6,726,205 | B1 | 4/2004 | Purton |

(Continued)

FOREIGN PATENT DOCUMENTS

| | | |
|---|---|---|
| WO | WO0051076 A1 | 8/2000 |

*Primary Examiner* — David Porta
*Assistant Examiner* — Hugh H Maupin
(74) *Attorney, Agent, or Firm* — Mark A. Litman & Associates, P.A.

(57) ABSTRACT

A method of reading suit and rank of playing cards is enabled on a system for controlled provision of image content of faces of a playing card that has:

e) a support surface for playing cards;
f) a source of infrared radiation;
g) an infrared sensitive camera; and
h) a processor.

The infrared sensitive camera positioned to capture infrared radiation transmitted through the playing cards and transmit information based on the captured radiation to the processor; and the processor configured to provide suit and rank information of a playing card through which the infrared radiation was transmitted.

20 Claims, 2 Drawing Sheets

(56) References Cited

U.S. PATENT DOCUMENTS

| | | | | |
|---|---|---|---|---|
| 7,967,672 | B2 | 6/2011 | Shigata | |
| 8,020,869 | B2 | 9/2011 | Kaji et al. | |
| 8,221,244 | B2 | 7/2012 | French | |
| 2004/0026636 | A1 | 2/2004 | Shigeta | |
| 2005/0242500 | A1* | 11/2005 | Downs, III | 273/149 R |
| 2007/0018389 | A1 | 1/2007 | Downs, III | |
| 2007/0102879 | A1 | 5/2007 | Stasson | |
| 2010/0019449 | A1 | 1/2010 | Downs, III | |
| 2010/0061342 | A1 | 3/2010 | Frederiks et al. | |
| 2011/0210175 | A1 | 9/2011 | Shigeta | |

* cited by examiner

PLAYING CARD IMAGING TECHNOLOGY WITH THROUGH-THE-CARD VIEWING TECHNOLOGY

BACKGROUND OF THE INVENTION

1. Field of the Invention

The present invention relates to the field of gaming, particularly card games, and even more particularly to the field of card gaming where security and management information relating to availability of card suit and rank is important.

2. Background of the Art

Digital camera sensors are inherently sensitive to infrared light, which would interfere with the normal photography by confusing the autofocus calculations or softening the image (because infrared light is focused differently from visible light), or oversaturating the red channel. Thus, to improve image quality and protect privacy, many digital cameras employ infrared blockers. Depending on the subject matter, infrared photography may not be practical with these cameras because the exposure times become overly long, often in the range of 30 seconds, creating noise and motion blur in the final image. Some lenses will also show a 'hot spot' in the center of the image as their coatings are optimized for visible light and not for IR.

An alternative method of DSLR (digital single lens reflex) infrared photography is to remove the infrared blocker in front of the sensor and replace it with a filter that removes visible light. This filter is behind the mirror, so the camera can be used normally—handheld, normal shutter speeds, normal composition through the viewfinder, and focus, all work like a normal camera. Metering works but is not always accurate because of the difference between visible and infrared reflection. When the IR blocker is removed, many lenses which did display a hotspot cease to do so, and become perfectly usable for infrared photography. Additionally, because the red, green and blue micro-filters remain and have transmissions not only in their respective color but also in the infrared, enhanced infrared color may be recorded.

While it is common to use a filter that blocks almost all visible light, the wavelength sensitivity of a digital camera without internal infrared blocking is such that a variety of artistic results can be obtained with more conventional filtration. For example, a very dark neutral density filter can be used (such as the Hoya ND400) which passes a very small amount of visible light compared to the near-infrared it allows through. Wider filtration permits an SLR viewfinder to be used and also passes more varied color information to the sensor without necessarily reducing the Wood effect. Wider filtration is however likely to reduce other infrared artifacts such as haze penetration and darkened skies. This technique mirrors the methods used by infrared film photographers where black-and-white infrared film was often used with a deep red filter rather than a visually opaque one.

Near infrared light consists of light just beyond visible red light (wavelengths greater than 780 nm). Contrary to popular thought, near infrared photography does not allow the recording of thermal radiation (heat). Far-infrared thermal imaging requires more specialized equipment, and is not the subject of this tutorial. Infrared images exhibit a few distinct effects that give them an exotic, antique look. Plant life looks completely white because it reflects almost all infrared light (because of this effect, infrared photography is commonly used in aerial photography to analyze crop yields, pest control, etc.) The sky is a stark black because no infrared light is scattered. Human skin tends to look pale and ghostly.

Infrared photography has been around for at least 70 years, but until recently has not been easily accessible to those not versed in traditional photographic processes. Since the charge-coupled devices (CCDs) used in digital cameras and camcorders are sensitive to near-infrared light, they can be used to capture infrared photos. With a filter that blocks out all visible light (also frequently called a "cold mirror" filter), most modern digital cameras and camcorders can capture photographs in infrared. In addition, they have LCD screens, which can be used to preview the resulting image in real-time, a tool unavailable in traditional photography without using filters that allow some visible (red) light through.

Remote sensing and thermographic cameras are sensitive to longer wavelengths of infrared. They may be multispectral and use a variety of technologies which may not resemble common camera or filter designs. Cameras sensitive to longer infrared wavelengths including those used in infrared astronomy often require cooling to reduce thermally induced dark currents in the sensor. Lower cost uncooled thermographic digital cameras operate in the Long Wave infrared band. These cameras are generally used for building inspection or preventative maintenance but can be used for artistic pursuits as well.

In the gaming industry, more and more technology is being used to combine traditional physical gaming elements (random event generators such as playing cards, dice and roulette wheels) with electronic systems that enable all aspects of the wagering games. For example, not only are wagers accepted and resolved through electronic systems, but physical event outcomes are electronically determined (read and analyzed) and this physical event is used in determining game outcomes. Of all the systems, the combination of electronic systems with playing card wagering games has been the most difficult, as the cards may vary in readability during the game (face-up versus face-down) and the images on the playing cards vary between decks. Many attempts have been made to effectively and accurately read playing cards during wagering games.

U.S. Pat. No. 6,403,908 (Stardust) discloses an automated method and apparatus for sequencing and/or inspecting decks of playing. The method and apparatus utilizes pattern recognition technology or other image comparison technology to compare one or more images of a card with memory containing known good images of a complete deck of playing cards to identify each card as it passes through the apparatus. Once the card is identified, it is temporarily stored in a location corresponding to or identified according to its position in a properly sequenced deck of playing cards. Once a full set of cards has been stored, the cards are released in proper sequence to a completed deck hopper. The method and apparatus also includes an operator interface capable of displaying a magnified version of potential defects or problem areas contained on a card which may then be viewed by the operator on a monitor or screen and either accepted or rejected via operator input. The present invention is also capable of providing an overall wear rating for each deck of playing cards. In order to certify that deck of playing cards is good and acceptable for play, the casino must ascertain that: (1) there is one and only one of each type (i.e. by suit and rank) of playing card in the deck of playing cards, (2) all of the backs of the playing cards contained in the deck are of the same color, (3) there are no defective playing cards (i.e. torn or cracked cards, cards with dimples or fingernail marks, cards with missing print or cards with spots), and (4) there are no boxed cards (cards facing backwards, etc.) contained in the deck of playing cards. Imaging cameras are used to obtain one or more images of each side of the card after the double card check is made. A low resolution is made of the front to determine suit and rank and back to determine color of the card. Generally, high resolution imaging is utilized to determine fine marks and problems. If the system is not in an inspect mode, it is possible to use the cameras simply to image a corner of the card, since the information necessary as to color and suit and rank is available in this portion of each card.

U.S. Pat. No. 5,941,769 (Order) discloses that in professional use in table games of chance with playing cards are provided which will register and evaluate all phases of the run of the game automatically. This is achieved by a card shoe with an integrated device for recognition of the value of the drawn cards (optical recognition device and mirroring into a CCD-image converter); photodiodes arranged under the table cloth to register separately the casino light passing through each area for placing the gaming chips and areas for placing the playing cards in dependence of the arrangement or movement of the chips and playing cards on the mentioned areas; a device for automatic recognition of each bet (scanner or a RFID-system comprising a S/R station and gaming objects with integrated transponder); an EDP program created in accordance with the gaming rules to evaluate and store all data transmitted from the functional devices to the computer; and a monitor to display the run of the game and players' wins.

U.S. Pat. No. 5,770,533 (Franchi) describes a casino operating system for controlling the flow of funds and monitoring gambling activities in a casino or a gaming establishment utilizing a network of computers, including a central computer and individual game computers. Each player receives an encoded betting card from the cashier. At the games, each player position is equipped with a control panel including a card reader into which the betting card is inserted. The control panel also includes an electronic screen and keyboard. From the control panel, the player may place a bet and perform all options available to the player in the particular game. The system records the hands dealt to each player and the winner, and credits or debits the player's betting card accordingly. In an alternative embodiment, the casino operating system allows the players to use chips to place bets instead of the above-described betting card. The chips are marked or encoded so that they can be counted once final bets have been placed to determine the amount of each player's bet. In games requiring the placement of bets in certain positions on the gaming table, each player may be provided with a betting marker used to indicate the position of his bets on the table, a touch-sensitive screen maybe used whereby bets are placed by touching the desired position on the screen, or a two-way remote control console for placing bets. The casino operating system is an open architecture system adaptable to accommodate the differing needs of each casino.

U.S. Pat. No. 4,531,187 (Uhland) describes a system for monitoring the play at gambling games is disclosed. The preferred embodiment comprises a system for monitoring the play at blackjack as that game is played in casinos. The system typically will comprise video monitor means for generating a digital representation of the bets made by the players and of the cards dealt to the players and to the dealer, so that an output can be generated indicating whether the correct payouts are made and bets collected. An alarm signal is generated if an error is made in the play of the game. An alarm signal may also be generated if the long-term statistics of the game indicate that the odds ordinarily applicable to the game have been departed from over a period of time.

U.S. Pat. No. 8,221,244 (French) describes methods and systems for intelligent tracking and/or play and/or management of card gaming use an intelligent card distribution or holding device with detectors for determining the value and unique identity of individual cards and for recording card play. Playing cards are equipped with a read/write data storage connected to a transponder and/or incorporated into electromagnetic writable particles or smart particles (smart dust). A system of the invention records various game play events on the playing cards themselves during game play and optionally also in a database on the system. In specific embodiments, the principal scanning and writing elements and electronic and optical interfaces are embodied into a hand-held card holder (HHCH). The system can scan playing cards, scan gaming chips, indicate a player's win/loss/draw, increase or decrease player betting positions, and compute awards to players based on their playing activity.

U.S. Pat. No. 7,967,672 (Shigeta) describes a card reading device that comprises a rail for guiding a card; card sensors for detecting a passing card which is slid by hand and guided by the rail, which are placed in a card sliding direction with a certain gap; and reading sensors for reading code attached to the card, which are placed between the two card sensors in the card sliding direction. The card have the cord which is printed in UV-luminous ink on the card, and the code comprises at least two code rows which are placed across the card sliding direction with a certain gap. The two reading sensors are placed in positions which correspond to the gap of the two code rows, and the card sensors output signal for detecting a position of the passing card.

U.S. Pat. No. 6,629,894 (Purton) describes a card inspection device that includes a first loading area adapted to receive one or more decks of playing cards. A drive roller is located adjacent the loading area and positioned to impinge on a card if a card were present in the loading area. The loading area has an exit through which cards are urged, one at a time, by a feed roller. A transport path extends from the loading area exit to a card accumulation area. The transport path is further defined by two pairs of transport rollers, one roller of each pair above the transport path and one roller of each pair below the transport path. A camera is located between the two pairs of transport rollers, and a processor governs the operation of a digital camera and the rollers. A printer produces a record of the device's operation based on an output of the processor, and a portion of the transport path is illuminated by one or more blue LEDs. Preferably a low temperature source of light is located so as to illuminate the area of the card that is being scanned.

The computer or signal processor compiles the scan data and reports and records the result of the scans of all of the cards in the one or more decks. FIG. 15 illustrates how a card transport path 400 may be subdivided by locating baffles above or below the roller pairs in order to create distinct zones. Each zone may have a particular form of detector, polarimeter, diode or line scanner as well as a particular light source or lighting method. By locating sensors both above and below the transport path, both sides of the card may be examined simultaneously. This provides the opportunity to detect suit and value of an inverted card as well as increasing the sophistication with which tampering may be detected. Polarized light may be used to detect certain forms of tampering. In such a case, the polarity of the light source may be rotated during the detection process. Similarly, a non-polarized source may be moved during the detection process to create a moving shadow. One or more light sources may be movable or set to illuminate off-axis so that certain forms of scratches and pinholes may be more easily detected by their shadow or reflectance. It is contemplated that both color and monochrome imaging methods may provide useful information about the condition of the cards. Similarly both digital and analogue sensing methods are seen to have independent utility and functionality with regard to both suit and value detection as well as the detection of faults, wear and tampering. It should be noted that the compartmentalization of the card transport path into distinct lighting and sensing zones may be applied to any embodiment disclosed.

Published U.S. Patent Application Document No. 20050242500 (Downs III) describes a sensing system for determining the rank and suit of playing cards. The system includes a sensing module capable of reading a line of data from a printed image, a position sensor and a hardware component that combines the signals from the sensing module and position sensor, converts the signal to binary values and compares the converted signal to stored signals. The comparisons are correlated to identify card rank and Suit. The system can be used in a playing card delivery shoe used to control the game of baccarat. The shoe may be a customary dealing shoe equipped with a sensing module, or may be a mechanized shoe. The mechanized shoe may comprise a) an area for receiving a first set of playing cards useful in the play of the casino table card game of baccarat; b) first card mover that moves playing cards from the first set to a playing card staging area wherein at least one playing card is staged in an order by which playing cards are removed from the first set of and moved to the playing card staging area; c) second playing card mover that moves playing cards from the playing card staging area to a delivery area wherein playing cards removed from the staging area to the delivery shoe are moved in the same order by which playing cards were removed from the first set of playing cards and moved to the playing card staging area; and d) playing card reading sensors that read at least one playing card value of each playing card separately after each playing card has been removed from the area for receiving the first set of playing cards and before removal from the playing card delivery area One exemplary sensing system is a CIS line scanning system with an associated card position sensor and a FPGA hardware element.

Published U.S. Patent Application Document No. 20070018389 (Downs III) describes a method and an apparatus determines at least one of rank or suit of a playing card. The apparatus has at least one two-dimensional complementary metal oxide semiconductor imaging system that provides a signal when playing cards are moved over the system. The signal is a series of gray scale values that are converted into binary values. The sensed data is transmitted to a hardware component that identifies at least one of rank and suit to an external data storage device.

Published U.S. Patent Application Document No. 20070102879 (Stasson) describes a playing card shuffling device has a visual display in information communication with the playing card shuffling device. At least one processor is programmed to provide displayable information to the visual display indicative of an amount of time remaining or time expired in a procedure performed by the shuffling device. FIG. 1 shows a partial perspective view of the top surface of a first shuffling and card verification apparatus according to a practice of the invention. In this example of the invention, the device randomizes and/or verifies one or two decks of cards. The shuffling apparatus has a card accepting/receiving area that is preferably provided with a stationary lower support surface that slopes downwardly from the nearest outer side of the shuffling and verifying apparatus. A depression is provided in that nearest outer side to facilitate an operator's ability to place or remove cards into the card accepting/receiving area. The top surface of the shuffling and verifying apparatus is provided with a visual display (e.g., LED, liquid crystal, micro monitor, semiconductor display, multi-segment display, etc.), and a series of buttons, touch pads, lights and/or displays. These elements on the top surface of the shuffling and verifying device may act to indicate power availability (on/off), shuffler state (jam, active shuffling, completed shuffling cycle, insufficient numbers of cards, missing cards, sufficient numbers of cards, complete deck(s), damaged or marked cards, entry functions for the dealer to identify the number of players, the number of cards per hand, access to fixed programming for various games, the number of decks being shuffled, card calibration information, mode of operation (i.e. shuffling, verifying or both shuffling and verifying) and the like), or other information useful to the operator or casino. Among the non-limiting examples of these techniques are 1) a sensor so that when a pre-selected portion of the card (e.g., leading edge, trailing edge, and mark or feature on the card) passes a reading device, such as an optical reader, the bottom pick-off roller is directed to disengage, revolve freely, or withdraw from the bottom of the set of cards; 2) the first set of nip rollers or off-set rollers may have a surface speed that is greater than the surface speed of the bottom pick-off roller, so that engagement of a card applies tension against the bottom pick-off roller and the roller disengages with free rolling gearing, so that no forward moving forces are applied to the first card or any other card exposed upon movement of the first card; 3) a timing sequence so that, upon movement of the bottom pick-off roller for a defined period of time or for a defined amount of rotation (which correlates into a defined distance of movement of the first card), the bottom pick-off roller disengages, withdraws, or otherwise stops applying forces against the first card and thereby avoids applying forces against any other cards exposed by movement of the first card from the card accepting/receiving area 106 and 4) providing a stepped surface (not shown) between pick-off roller and off-set rollers 146 that contacts a leading edge of each card and will cause a card to be held up or retained in the event that more than one card feeds at a time.

Other disclosures have also contemplated optically reading of playing cards. For example, U.S. Pat. Nos. 6,582,301; 6,039,650; and U.S. Pat. No. 5,722,893 to Hill et al. describes a shoe with a card scanner, which optically scans a playing card as the card moves out of shoe. The card suit and value is then recognized by a neural-network algorithm. Other disclosures have also attempted to track cards by use of card shoes that optically recognize the cards as they are drawn from the shoe. For example, U.S. Pat. Nos. 5,941,769 and 6,460,848 disclose a card shoe with an optical device that deflects and transmits a reflected image of the card value imprint from the drawn playing card to a CCD image converter. Still other disclosures have attempted to combine detection of playing cards optically and gambling chips by some means. For example, U.S. Pat. Nos. 5,605,334; 6,093,103 and U.S. Pat. No. 6,117,012 to McCrea et al., disclose a game table system for monitoring each hand in a progressive live card game. The system comprises a shoe that optically detects the value and suit of each card, a game bet sensor to detect the presence or absence of a bet, a card sensor located at each player position to detect the presence or absence of a playing card, and a game control. The game control receives information on the presence or absence of a bet or playing card to ensure a bet is placed before the playing card is dealt.

Published U.S. Patent Application Document No. 20100019449 (Downs III) describes how a playing card delivery shoe is used in the play of the casino table card game of baccarat or blackjack or any game where cards are pulled one at a time from the shoe. The apparatus comprises a reader or an imager that scans lines bisecting the image at spaced intervals. The scanning occurs on playing cards in at least the region where suit and rank symbols are provided. The scanner output is a series of voltages that are converted to binary information. This binary information is compared to stored binary information to determine rank and suit. The upper surface of the output end of the shoe contains a partial barrier for cards being scanned. The partial barrier has an elevated surface and limits a size of a pathway so that only one card can be removed at a time.

U.S. Pat. No. 6,460,848 (SOLTYS) describes a system that automatically monitors playing and wagering of a game, including the gaming habits of players and the performance of employees. A card deck reader automatically reads a symbol from each card in a deck of cards before a first one of the cards is removed. The symbol identifies a respective rank and suit of the card. There are numerous other related patents including U.S. Pat. Nos. 6,712,696; 6,688,979; 6,685,568; 6,663,490; 6,652,379; 6,638,161; 6,595,857; 6,579,181; 6,579,180; 6,533,662; 6,533,276; 6,530,837; 6,530,836; 6,527,271; 6,520,857; 6,517,436; and 6,517,435.

Other systems known to be available for reading of card symbols (e.g., suits and rank) include at least WIPO Published Application WO/2000/051076 (Dolphin); Published U.S. Patent Application Documents No. 2011020175; 2010061342; 20040026636; and U.S. Pat. Nos. 6,726,205; 6,527,191; 6,533,276 and 8,020,869.

All of the references cited herein are incorporated by reference in their entirety to assist in providing enabling background for systems and technology and methods.

SUMMARY OF THE INVENTION

A method of reading suit and rank of playing cards is enabled on a system for controlled provision of image content of faces of a playing card that has:

a) a support surface for playing cards;

b) a source of infrared radiation;

c) an infrared sensitive camera; and d) a processor.

The infrared sensitive camera positioned to capture infrared radiation transmitted through the playing cards and transmit information based on the captured radiation to the processor; and the processor configured to provide suit and rank information of a playing card through which the infrared radiation was transmitted. The use of a cut-off filter in the camera that excludes or reduces non-useful ranges of wavelengths (e.g., visible and/or UV) and allows more useful (infrared) ranges of wavelengths sharpens images or card values for viewing.

DETAILED DESCRIPTION OF THE INVENTION

Figure 1:
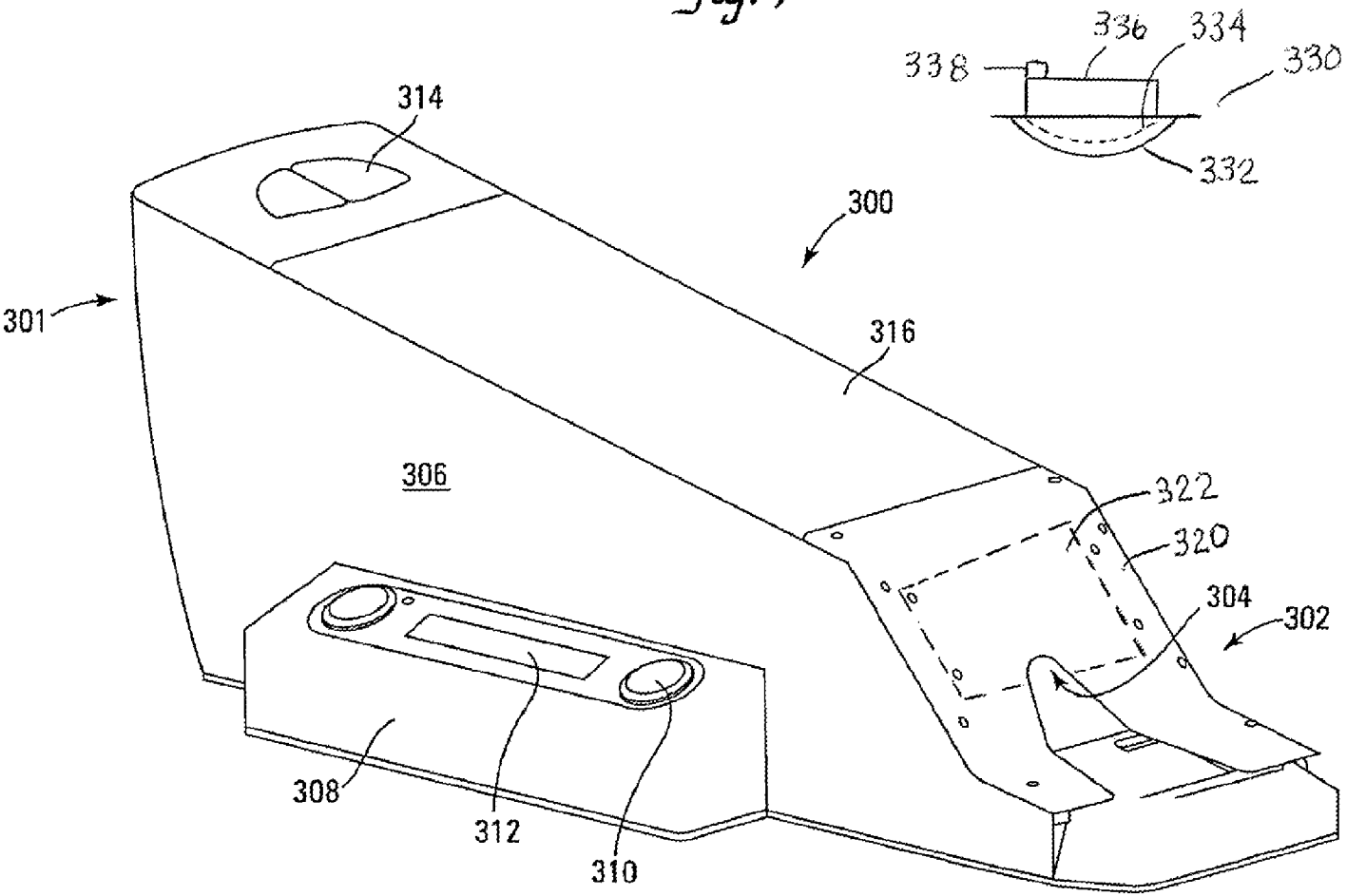
FIG. 1 shows a perspective view of a playing card delivery shoe useful within the scope of the present technology in combination with an overhead camera.

The present technology includes a system and method. The method reads information from a playing card while an image face of the playing card is hidden by a visible light-opaque back. An infrared-sensitive camera is positioned over the playing card back and receives infrared information passing through the playing card. A filter on the camera filters out at least some visible and some infrared radiation, allowing a defined range of infrared radiation into the camera. The camera captures radiation within the defined range of radiation and transmits (and/or temporarily stores) signals based on the captured radiation. A processor receives the transmitted signals and executes code to define patterns in the captured radiation. The defined patterns include image content of suit and rank on the image face of the playing card.

The filter has defined cut-off range and a maximum transmission range. The maximum transmission range is within the near infrared range, such as between 780 nm and 1100 nm. There are numerous specific methodologies within the generic scope of the present technology. One subgeneric method uses radiation passing through the playing card that is emitted below the image face of the playing card and transmitted through the playing card to the camera.

A second subgeneric method uses infrared radiation passing through the playing card that is emitted above the image face of the playing card, passes through the playing card back a first time and is reflected, then transmitted through the playing card back a second time to the camera. In the second subgeneric method, light passing through the playing card back the first time is emitted by an infrared source above the back of the playing card. Low intensity lamps may be provided above the gaming table, in the ceiling, as wall lights or as a standing lamp. The back of the playing card may be in contact an inner surface (capable of transmitting infrared radiation, i.e., transmissive of infrared radiation) on a card delivery shoe or tray, and the emitted light passes through the inner surface a first time and the reflected infrared radiation then passes through the inner surface a second time and is captured by the infrared sensitive camera. It is to be understood that the use of an underlying card as an infrared radiation reflective surface while it must also be able to transmit radiation through a similar surface twice is not contradictory, but is a surprising aspect of the present invention. An analysis of the functional capabilities will support this aspect of the present technology.

Assume that a playing card absorbs and reflects a maximum total of X % of infrared radiation (of a defined wavelength range) passing through the card (including the back side of the playing card) and the top (back side) of the card reflects (does not include absorption) a minimum of Y % of infrared radiation of the same wavelength range. Therefore, reflected radiation passes through the card twice and must be reflected off an adjacent card once. In approximating mathematic terms, with an initial intensity striking the back of the top playing card, the scenario would be expressed as follows:

With an incident IR radiation intensity (Ir) striking a top of two cards, the intensity $Ir_1$ passing through the first card would be (100-X)%/X times Ir. That is the intensity (In) that strikes the back of the underlying playing card. Of that incident radiation striking the underlying card, (Y)% is reflected. Therefore Y $Ir_1$ is reflected off the back of the underlying card. Approximately (100-X)% of that Y $Ir_1$ is transmitted through the playing card. It is understood that Y<X (as X includes reflection Y and absorption components).

Using prophetic but reasonable values for X and Y, the practical use of this reflective system can be appreciated. Assuming that X % is 80% and Y % (reflection) is 40%, with a normalized Ir of 100 light units, the intensity ($Ir_1$) that strikes the back of the underlying playing card is 20 light units. The amount reflected off the underlying card would therefore be 40%×20 light units, or 8 light units. The amount transmitted through the top card (the second transmission through that card) would be (100-80)%×8 light units, or aminimum of 1.6 light units. This is sufficient amount of infrared radiation to enable cameras to receive and interpret reflected image data. This has been proven by actual working models.

In addition to these conservative numbers, it must be appreciated that as cards are differentially absorbing the infrared radiation (with higher or lower infrared optical densities in the suit and rank images), with the 1.6 light units being the minimum transmitted through the card the second time, more is transmitted through lower optical density areas of the playing card. The contrast is created by the difference in absorption creates the image data. Where the transmission and reflection pathways are approximately perpendicular, the amount absorbed/reflected in low optical density image areas can be substantially less than in high optical density areas. The perpendicular path passes through the low optical density area twice and the high optical density area twice, increasing the contrast.

In the first subgeneric method, the infrared radiation passing through the playing card may be emitted from infrared emitters within a card handling device, such as a card handling device selected from the group consisting of a delivery shoe, shuffling apparatus or card randomizing apparatus.

In both methods, the playing card may be present within a playing card delivery shoe, and the image content comprises image content of a top playing card in the delivery shoe. At least some reflected radiation is reflected from a back of an at least second playing card within the delivery shoe adjacent the top playing card. The inner surface on the card handling device (e.g., the panel over the cards in a delivery tray in a shuffler or delivery shoe) may be translucent to a range of infrared radiation within the transmission range between 780 nm and 1100 nm.

A system for controlled provision of image content of faces of a playing card may have:

a) a support surface for playing cards;

b) a source of infrared radiation;

c) an infrared sensitive camera; and d) a processor.

The infrared sensitive camera is positioned to capture infrared radiation transmitted through the playing cards and transmit information based on the captured radiation to the processor; and the processor is configured to provide suit and rank information of a playing card through which the infrared radiation was transmitted.

As with the two subgeneric aspects of the present technology, the source of infrared radiation is below the playing card through which the infrared radiation was transmitted and the infrared camera is above the playing card through which the infrared radiation was transmitted, or the source of infrared radiation is above the playing card through which the infrared radiation was transmitted, so that the infrared radiation is transmitted through the playing card after reflection and the infrared camera is above the playing card through which the infrared radiation was transmitted.

The source of infrared radiation may be located in a gaming table, in a playing card delivery shoe or in a playing card shuffling device. The support surface for playing cards may be a casino gaming table top or be within a playing card delivery shoe or shuffler and a source of infrared radiation is above and external to the playing card delivery shoe or shuffler. An upper surface above the playing card support surface may transmit infrared radiation in a range between 780 nm and 1100 nm. A video display screen may be present, and the processor may be configured to transmit image data of the playing card suit and rank to the video display screen and the video display screen is configured to enable display of the transmitted image data.

In photography, a filter is a camera accessory consisting of an optical filter that can be inserted in the optical path. The filter can be a square or oblong shape mounted in a holder accessory, or, more commonly, a glass or plastic disk with a metal or plastic ring frame, which can be screwed in front of or clipped onto the lens.

Filters modify the images recorded. Sometimes they are used to make only subtle changes to images; other times the image would simply not be possible without them. In monochrome photography, colored filters affect the relative brightness of different colours; red lipstick may be rendered as anything from almost white to almost black with different filters. Others change the color balance of images, so that photographs under incandescent lighting show colours as they are perceived, rather than with a reddish tinge. There are filters that distort the image in a desired way, diffusing an otherwise sharp image, adding a starry effect, etc. Supplementary close-up lenses may be classified as filters. Linear and circular polarising filters reduce oblique reflections from non-metallic surfaces.

Many filters absorb part of the light available, necessitating longer exposure. As the filter is in the optical path, any imperfections—non-flat or non-parallel surfaces, reflections (minimised by optical coating), scratches, dirt—affect the image.

There is no universal standard naming system for filters. The Wratten numbers were adopted in the early twentieth century and are used by several manufacturers. Color correction filters are often identified by a code of the form CC50Y-CC for color correction, 50 for the strength of the filter, Y for yellow.

Optical filters are used in various areas of science, including in particular astronomy; they are essentially the same as photographic filters, but in practice often need far more accurately-controlled optical properties and precisely-defined transmission curves than filters exclusively for photographic use. Photographic filters sell in larger quantities at correspondingly lower prices than many laboratory filters.

A #87C filter will filter out all visible light, but since these filters gradually filter out more and more light as the wavelength increases, the #87C will also filter out a good amount of the infrared light. All though it filters out all visible light, it still lets in enough of the infrared spectrum for clear crisp images. The #25 filter lets in a significant amount of red light, and is often used in traditional photography because it allows image previewing through the viewfinder.

The following is a table of % light transmission at different wavelengths for a few of the filters specified above. One should be able to figure out the approximate behavior of the other filters by comparing them to this table.

| | % Transmission | #25 | #89B | #87 | #87C |
|---|---|---|---|---|---|
| . . . ~ | @ 550 nm | — | — | — | — |
| . . . \| | @ 600 nm | 50.00 | — | — | — |
| Visible | @ 650 nm | 87.60 | — | — | — |
| Light | @ 700 nm | 89.50 | 11.20 | — | — |
| . . . \| | @ 750 nm | 89.50 | 83.10 | 03.50 | — |
| . . . x | @ 800 nm | 89.50 | 88.10 | 56.90 | 3.00 |
| . . . \| | @ 850 nm | 89.50 | 89.20 | 78.50 | 48.40 |
| . . . \| | @ 900 nm | 89.50 | 89.90 | 81.90 | 80.60 |
| Infrared | @ 950 nm | 89.50 | 90.40 | 83.60 | 86.50 |
| Light | @ 1000 nm | 89.50 | 90.50 | 85.30 | 89.20 |
| . . . \| | | | | | |
| . . . ~ | | | | | |

A consideration of the Figures will assist in a further appreciation of the scope and content of the present invention.

FIG. 1 shows a perspective view of a playing card delivery shoe 300 useful within the scope of the present technology in combination with an overhead camera system 330. The deliver shoe 300 is shown with its front delivery portion 302, a finger slot 304 for removal of playing cards (not shown), its back 301, side 306 and top panels 316 of the delivery shoe 300. A more modern mechanized shoe 300 is shown with card entry panel cover 314, side information and activation controls 308, with dealer information display 312 and activation button 310. To assist in enablement of one aspect of the present invention, the infrared penetrable front panel 320 and the internal infrared emission system 322 is shown. The emission system 322 may be any technologically available source of IR, especially IR within the range of 780-1200 nm, and more preferably within the range of 780 to 1100 nm. The emission system 322 should provide enough fluence of IR radiation that the IR radiation will penetrate the playing cards (not shown) behind the front panel 320 and above the mission source 322 and then be received by the camera system 330 which is often present on the ceiling in a gaming environment. These camera systems 330 are part of what is referred to as the "eye-in-the-sky" viewing systems within casinos. The infrared radiation emitted from the system 320 penetrates at least one playing card that has been advanced into the front end 302 of the delivery shoe 300, and may include two or more (up to a reasonable limit to minimize IR emission requirements) playing cards. It is also an enabled embodiment of the present technology to use ambient or enhanced IR emissions in the casino environment to penetrate the IR transmissive cover 320, penetrate a top card (the first card immediately under the plate 320), be reflected (in-part) by the top-side of the second playing card within the front end 302 of the delivery shoe 300 and then repenetrate IR transmissive cover 320 and then be transmitted to and captured by the camera system 330. It is surprising that, especially with a cut-off filter 334 within the cover 332 or as the cover 332, modest amounts of ambient IR radiation can function accurately in this type of system. Filtered radiation (having passed through cover 332 and cutoff filter 334 is then captured by the camera element 336 and the data from the captured signal (processed or not by a processor within the camera element 336 is the transmitted through an output port (wired or wireless) 338 to a system that can electronically read and/or or display the captured IR image data of the playing card information.

The cutoff filters are selected upon design parameters that are still novel and non-obvious within the context of the present technology, even though cutoff filters may be themselves commercially available with the properties that might be needed. The cutoff filters effectively limit the radiation to which the cameras are sensitive to the range of radiation passing through the playing cards. For example, if the emission system or ambient IR penetrating playing cards has its maximum IR range within 800-1000 nm, the use o a cutoff filter allowing most of all radiation between 800-1000 nm to penetrate the filter, while absorbing or blocking most radiation below 790 nm and above 1010 nm is effective is provide a sharper image, with higher contrast, of the playing card(s) by removing background, or extraneous radiation wavelengths from the camera system. As visible light is likely to be more intense than the IR radiation passing through the cards, it would be more difficult for a system to try to discern what portions of the image data were useful in reading card information when the vast amount of energy entering the camera (if unfiltered) would likely be visible and/or ultraviolet radiation. The cutoff filter increases the likelihood that most radiation received by the camera is useful card image information.

Figure 2:
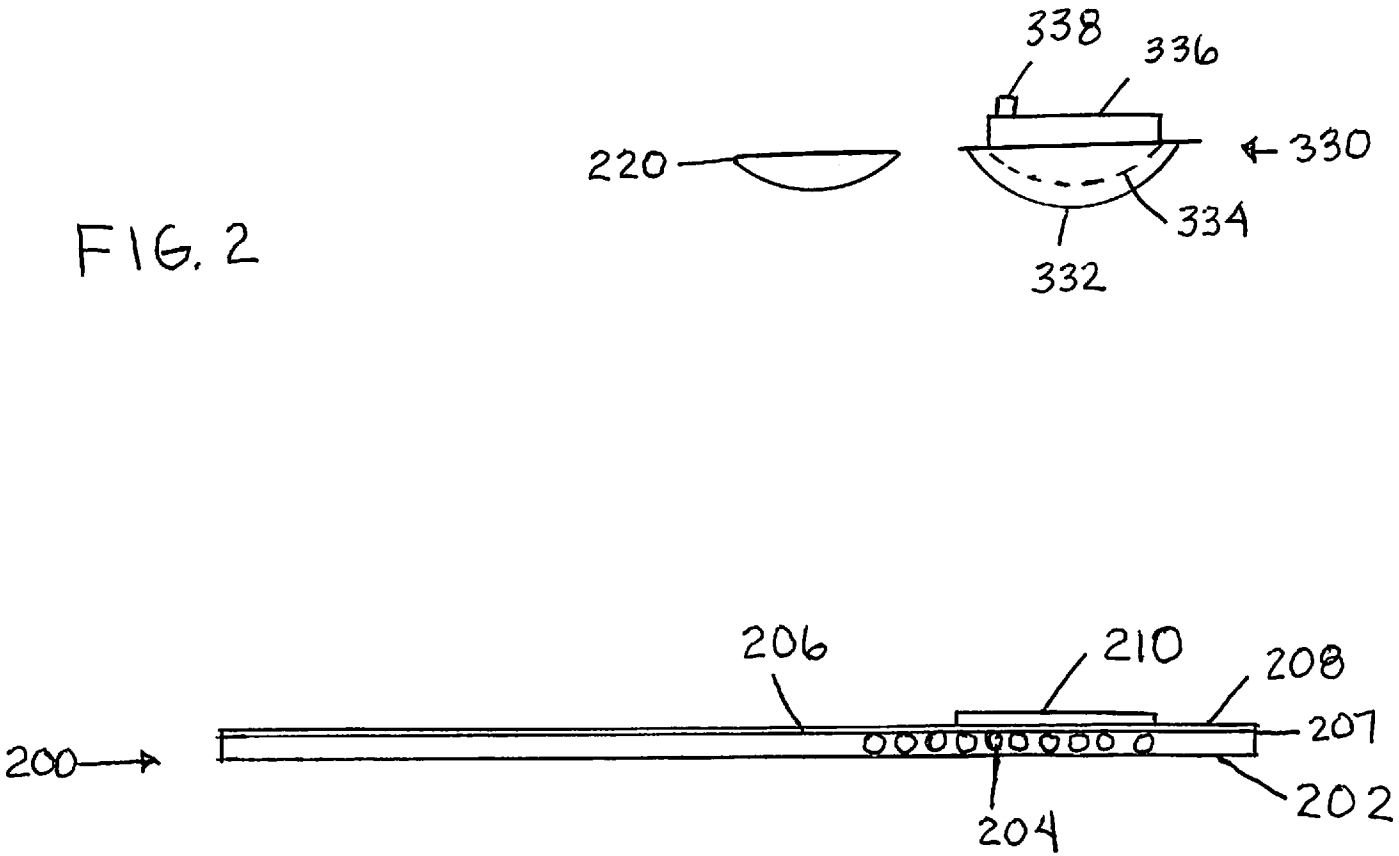
FIG. 2 shows a gaming table layout with through-card reading capability on the table top itself in combination with an overhead camera.

The cutoff filters would similarly work within the camera information receiving capability on a tabletop viewing system, such as that shown in FIG. 2. FIG. 2 shows a gaming table layout with through-card reading capability on the table top itself 200 in combination with an overhead camera 330. All numbering that is identical with that from FIG. 1 represents an identical component. The tabletop 200 is shown with a base layer 202, a surface layer 206 (which, by way of non-limiting examples, may be felt or a felt laminate), and interface or reflective and/or transmissive layer 207, and a playing card 210 on the surface 208 of surface layer 206. An optional (but preferred) system of IR emitters 204 embedded in the base layer 202 of the tabletop 200 is shown. Where the IR emitters 204 are present in a system, emitted IR radiation passes out of the base layer 202 and through the interface or transmissive layer 207, through the surface layer 206, through the playing card 210 (creating differential contrast images of playing card faces or values (not shown) and is captured by one or more camera systems 330. The captured contrast images are then processed as described in the operation of data capture and image formation in FIG. 1. An ambient source of IR radiation 220 which could be on walls or the ceiling, emitting effective but harmless-to-human levels of background IR radiation is also shown. These sources of IR radiation would emit IR radiation at wavelengths designed to benefit or optimize the performance of reflection off the surface 208 of the tabletop 200 or reflect off interface or layer 207 (where that layer or interface is constructed of IR reflective material). For example, if the cutoff filter layer 334 in the camera system 330 and the camera 336 were designed to have maximum imaging capability between 800 nm and 850 nm, the IR source 220 would emit at maximum intensity between 800 and 850 nm, and the surface 208 and/or the surface layer 206 would be designed to efficiently reflect IR radiation between wavelengths of 800 nm and 850 nm.

As shown in reference materials cited herein, there are numerous imaging technologies that can be used with the captured image data to assist in determining playing card information (e.g., suit, rank, authenticity, verification of composite hands, etc.). Any of these software or computational or imaging technologies can be used in the practice of the present technology.

What is claimed:

1. A method of reading information from a playing card while an image face of the playing card is hidden by a visible light-opaque back comprising:

an infrared-sensitive camera positioned over the playing card back receives infrared information passing through the playing card;

a filter on the camera filtering out at least some visible and some infrared radiation, allowing a defined range of infrared radiation into the camera;

the camera capturing radiation within the defined range of radiation and transmitting signals based on the captured radiation;

a processor receiving the transmitted signals and executing code to define patterns in the captured radiation; and the defined patterns including image content of suit and rank on the image face of the playing card.

2. The method of claim 1 wherein the filter has a maximum transmission range between 780 nm and 1100 nm.

3. The method of claim 2 wherein radiation passing through the playing card is emitted below the image face of the playing card and transmitted through the playing card to the camera.

4. The method of claim 3 wherein the infrared radiation passing through the playing card is emitted from infrared emitters within a card handling device.

5. The method of claim 3 wherein the card handling device is selected from the group consisting of a delivery shoe, shuffling apparatus or card randomizing apparatus.

6. The method of claim 2 wherein infrared radiation passing through the playing card is emitted above the image face of the playing card, passes through the playing card back a first time and is reflected, then transmitted through the playing card back a second time to the camera.

7. The method of claim 6 wherein light passing through the playing card back the first time is emitted by infrared sources above the back of the playing card.

8. The method of claim 7 wherein the back of the playing card is in contact an inner surface on a card delivery shoe or tray, and the emitted light passes through the inner surface a first time and the reflected infrared radiation then passes through the inner surface a second time and is captured by the camera.

9. The method of claim 8 wherein the playing card is present within a playing card delivery shoe, and the image content comprises image content of a top playing card in the delivery shoe.

10. The method of claim 9 wherein at least some reflected radiation is reflected from a back of an at least second playing card within the delivery shoe adjacent the top playing card.

11. The method of claim 10 wherein the inner surface is translucent to infrared radiation within the transmission range between 780 nm and 1100 nm.

12. The method of claim 1 a radiation cutoff filter is positioned between the playing cards and the infrared sensitive camera, the cutoff filter reducing amounts of visible radiation passing through the filter at a rate greater that the rate of reduction of IR radiation to which the infrared sensitive camera is sensitive.

13. A system for controlled provision of image content of faces of a playing card comprising:

a) a support surface for playing cards;

b) a source of infrared radiation;

c) an infrared sensitive camera; and d) a processor;

the infrared sensitive camera positioned to capture infrared radiation transmitted through the playing cards and transmit information based on the captured radiation to the processor; and the processor configured to provide suit and rank information of a playing card through which the infrared radiation was transmitted.

14. The system of claim 13 wherein a video display screen is present and the processor is configured to transmit image data of the playing card suit and rank to the video display screen and the video display screen is configured to enable display of the transmitted image data.

15. The system of claim 13 wherein a radiation cutoff filter is positioned between the playing cards and the infrared sensitive camera, the cutoff filter reducing amounts of visible radiation passing through the filter at a rate greater that the rate of reduction of IR radiation to which the infrared sensitive camera is sensitive.

16. The system of claim 13 wherein the source of infrared radiation is below the playing card through which the infrared radiation was transmitted and the infrared camera is above the playing card through which the infrared radiation was transmitted.

17. The system of claim 16 wherein a source of infrared radiation is located in a gaming table, in a playing card delivery shoe or in a playing card shuffling device.

18. The system of claim 13 wherein the source of infrared radiation is above the playing card through which the infrared radiation was transmitted, so that the infrared radiation is transmitted through the playing card after reflection and the infrared camera is above the playing card through which the infrared radiation was transmitted.

19. The system of claim 18 wherein the support surface for playing cards is within a playing card delivery shoe or shuffler and a source of infrared radiation is above and external to the playing card delivery shoe or shuffler.

20. The system of claim 18 wherein an upper surface above the playing card support surface transmits infrared radiation in a range between 780 nm and 1100 nm.

* * * * *